US005521381A

United States Patent [19]

Gregg et al.

[11] Patent Number: 5,521,381

[45] Date of Patent: May 28, 1996

[54] CONTAMINATION ANALYSIS UNIT

[75] Inventors: Hugh R. Gregg; Michael P. Meltzer, both of Livermore, Calif.

[73] Assignee: The Regents of the University of California, Oakland, Calif.

[21] Appl. No.: 354,325

[22] Filed: Dec. 12, 1994

[51] Int. Cl.[6] ..... H01J 49/04

[52] U.S. Cl. ..... 250/288; 250/289; 250/441.11

[58] Field of Search ..... 250/288, 289, 250/441.11

[56] References Cited

U.S. PATENT DOCUMENTS

| | | | |
|---|---|---|---|
| 3,346,736 | 10/1967 | Neuhaus | 250/310 |
| 4,584,479 | 4/1986 | Lamattina et al. | 250/441.11 |
| 4,820,920 | 4/1989 | Bather | 250/288 |

*Primary Examiner*—Jack I. Berman

*Attorney, Agent, or Firm*—Henry P. Sartorio; John P. Wooldridge

[57] ABSTRACT

The portable Contamination Analysis Unit (CAU) measures trace quantifies of surface contamination in real time. The detector head of the portable contamination analysis unit has an opening with an O-ring seal, one or more vacuum valves and a small mass spectrometer. With the valve closed, the mass spectrometer is evacuated with one or more pumps. The O-ring seal is placed against a surface to be tested and the vacuum valve is opened. Data is collected from the mass spectrometer and a portable computer provides contamination analysis. The CAU can be used to decontaminate and decommission hazardous and radioactive surface by measuring residual hazardous surface contamination, such as tritium and trace organics It provides surface contamination data for research and development applications as well as real-time process control feedback for industrial cleaning operations and can be used to determine the readiness of a surface to accept bonding or coatings.

16 Claims, 1 Drawing Sheet

CONTAMINATION ANALYSIS UNIT

The United States Government has rights in this invention pursuant to Contract No. W-7405-ENG-48 between the United States Department of Energy and the University of California for the operation of Lawrence Livermore National Laboratory.

BACKGROUND OF THE INVENTION

1. Field of the Invention

The present invention relates to the detection of contaminants, and more specifically, it relates to a unit which performs contamination analysis.

2. Description of Related Art

One of the biggest sources of hazardous waste and VOC air emissions throughout American industry is parts and equipment cleaning operations. These operations include cleaning related to metal fabrication and finishing processes such as machining and electroplating, as well as electronic fabrication processes that include printed circuit board manufacture and component assembly activities. Parts and equipment cleaning is an integral part of a wide range of major industries such as aerospace, electronics equipment and computer manufacture, medical equipment manufacture, chemical manufacturing, and many others.

In all of these industry segments, large quantities of hazardous solvents (both halogenated and nonhalogenated) are routinely employed, and eventually find their way into a waste stream, or are emitted into the air. In 1991 for instance, the U.S. demand for four commonly used halogenated cleaning solvents (trichloroethylene, perchloroethylene, methylene chloride, and 1,1,1 trichloroethane) totaled nearly 200,000 metric tons; of this, one gallon in three was used for parts and equipment cleaning.

A common, and effective approach to hazardous cleaning solvent waste and emissions reduction has been to substitute environmentally more benign materials whenever possible. While this is an excellent approach and is responsible for significant pollution prevention, there are still many cleaning applications in which chlorinated or other hazardous and volatile solvents are required. In these cases, it is essential to use the chemicals in as efficient and conservative a manner as possible. Waste due to unnecessary parts cleaning, or due to recleaning parts that were improperly handled the first time, should be avoided through accurate process controls and contamination analysis procedures.

Unfortunately, this is not the case in most industries. While many U.S. manufacturing processes are now state of the art and highly efficient, parts and equipment cleaning lags sorely behind, especially in the area of real-time process controls. One of the most common methods in aircraft manufacture, for instance, for determining when a wing or fuselage section is clean enough, is a water-break test. This highly variable, non-quantitative approach determines that a part is supposedly clean when water runs off the surface in a sheet rather than beading up. This method has been referred to as a "nineteenth century approach", and varies markedly depending on the cleaners used (for instance, detergent on a part surface will cause water to sheet off and make the surface appear clean, even when considerable soil can be present). Laboratory analyses of surface contamination are also used as spot checks of cleaning performance, but these tests have turnaround times of several days or longer, and often don't identify a problem until many parts have been improperly cleaned.

A need exists for a real-time feedback mechanism for verification of cleaning performance in the aerospace industry. Electronics companies also have many applications for such technology. The method of minimizing cleaning problems in some instances has been to use procedures that overclean most parts in the hopes of adequately cleaning all of them. Improper cleaning is sometimes not detected until after an assembly is completely built.

A need exists for a sensing technology that can provide real-time cleaning verification feedback in an industrial production line environment, and to make this technology robust enough that it can be used in a wide range of industries and particular applications. The technology should be portable so that it can quickly be moved from one part of an assembly line to another. It should generate highly precise data. Hydrocarbon contamination layer thicknesses of a fraction of nanometer should be routinely measurable. This corresponds to contamination one or two atomic layers thick that can be measured. The sensor should identify the type of contamination, distinguish between different hydrocarbon species, and detect other common contaminants, such as silicone oils. Finally, the components of the sensor should be inexpensive. The present invention provides these advantages.

SUMMARY OF THE INVENTION

It is an object of the present invention to provide an inexpensive and portable contamination analysis unit.

It is another object of the present invention to provide real-time cleaning verification feedback in an industrial production line environment.

Still another object of the invention is to provide a sensor that can identify contamination type.

It is an object of the invention to provide a unit that can distinguish between different hydrocarbon species.

Another object of the present invention is to provide a sensor unit that can identify silicone oils.

Another object of the present invention is to provide a sensor unit that can identify other volatile and semi-volatile contaminants such as dried solder fluxes.

Yet another object of the invention is to be able to quantify the amount of the detected contamination.

The portable Contamination Analysis Unit (CAU) measures trace quantities of surface contamination in real time. Industrial parts and equipment cleaning generates large volumes of hazardous waste and air emissions. A strong need exists for effective pollution prevention in this area. Two major waste generating mechanisms are: unnecessary overcleaning (involving nonessential hazardous solvent application) and undercleaning (requiring rework and more waste generation). Both can be avoided through real-time analysis of and feedback on contamination levels on parts surfaces.

The detector head of the portable contamination analysis unit has an opening with an O-ring seal, one or more vacuum valves and a small mass spectrometer for an analyzer. With the valve closed, the mass spectrometer is evacuated with one or more pumps. The O-ring seal is placed against a surface to be tested and the vacuum valve is opened. The vacuum aids in desorbing contaminants from the surface to be tested, so that they can be measured by the mass spectrometer. To augment this desorption, an internal heat source is installed inside the sensor and heats the surface to be tested. A laser could also be mounted on or in the sensor, to provide laser desorption of difficult to desorb contaminants. Data is collected from the mass spectrometer and a portable computer provides contamination analysis.

The CAU can be used to decontaminate and decommission hazardous and radioactive surfaces by measuring residual hazardous surface contamination, such as tritium and trace organics. It provides surface contamination data for research and development applications as well as real-time process control feedback for industrial cleaning operations. It can also be used to determine the readiness of a surface to accept bonding or coatings (i.e. paint, metal platings, etc.).

DETAILED DESCRIPTION OF THE INVENTION

Figure 1:
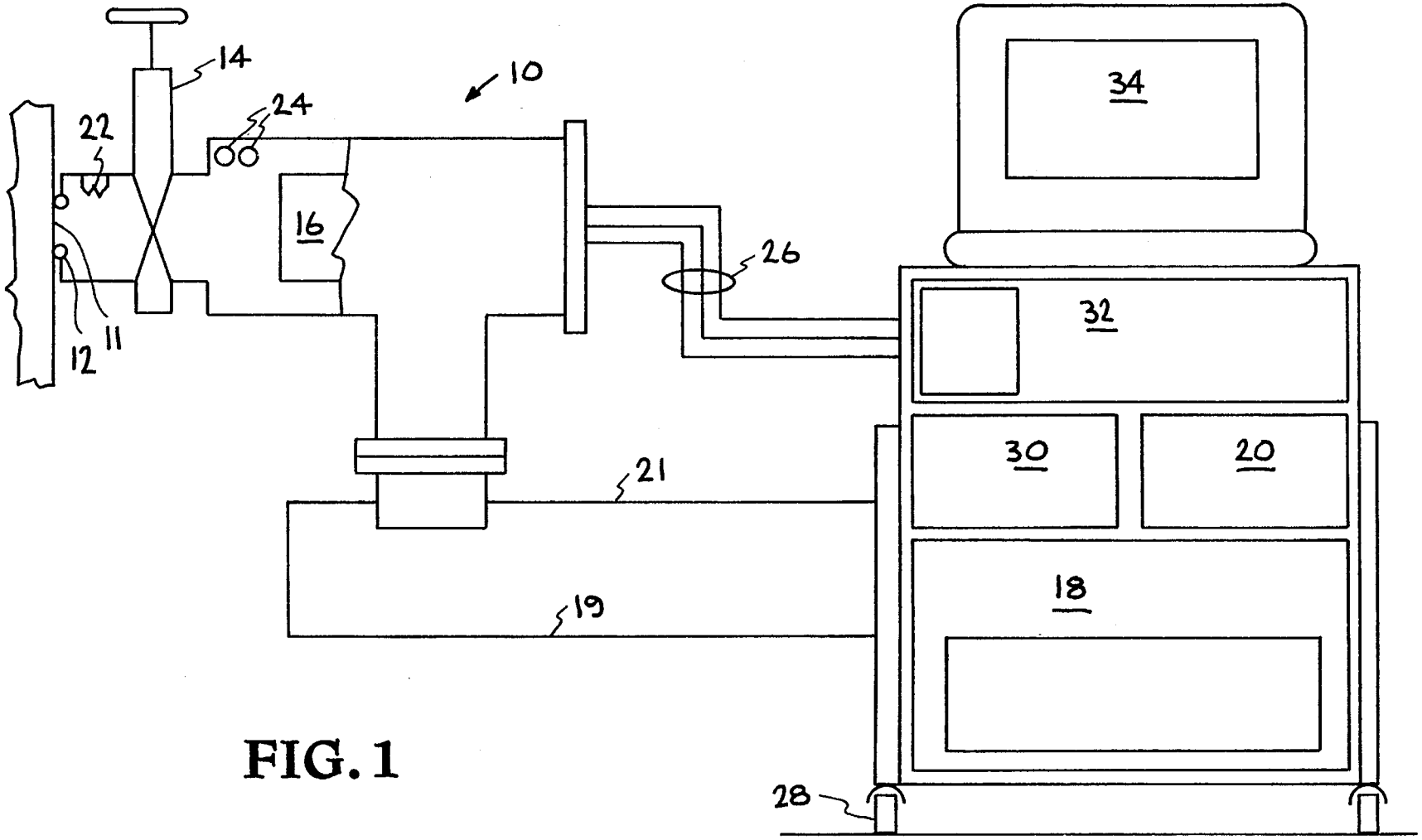
FIG. 1 shows a schematic of the portable contamination analysis unit.

As shown in FIG. 1, the detector head 10 of the portable contamination analysis unit has an opening 11 with an O-ring 12, one or more vacuum valves 14 and a small mass spectrometer 16 (e.g., a residual gas analyzer quadrupole mass spectrometer or a time-of-flight mass spectrometer) as an analyzer. With the valve closed, the mass spectrometer 16 is first evacuated with one or more pumps (for example, a roughing pump such as a rotary vane pump and controller 18 with roughing line 19, and turbomolecular pump and controller 20 with turbomolecular line 21 ). The O-ring 12 is placed against a surface to be tested and the vacuum valve 14 is opened. The vacuum aids in desorbing contaminants from the surface to be tested, so that they can be measured by the mass spectrometer. To augment this desorption, an internal heat source 22 such as a nichrome wire or coil that heats the surface to be tested is installed inside the detector head 10. Other heaters include infrared heaters, quartz heaters, etc. Heater 22 can be a laser mounted on or in the detector head 10 to provide laser desorption of difficult to desorb contaminants. Data is collected by the mass spectrometer 16 as the desorbed contaminants pass through it. Pressure sensors 24 in the detector head measure the level of vacuum.

The detector head 10, which is easily hand-held, is connected by electrical cables 26 to a cart containing the electronics and power supplies that interpret the data and run the equipment in the detector head. The cables to the cart may be as long as needed. The cart is on wheels 28, and is light enough to be pushed around by hand. It contains the power supply and digital controls and readout for the heating element in the detector head, as well as the power supply for the laser, should a laser be installed in the detector head. The pressure gauge and readout 30 for the vacuum sensors 24 that measure the vacuum level in the detector head 10 are also in the cart. The pressure gauge is electrically connected to the pressure sensor. The cart contains mass spectrometer controller 32, portable computer 34 (e.g., a laptop computer) and software specially designed for the CAU that will interpret the data, recording the mass spectra of the desorbed contamination at various temperatures, and plotting these in graphical form.

Different contaminants have different "signatures"—i.e., different locations and shapes of flux peaks on the graphs. A library of different contaminant signatures for many typical contaminants is included in the computer software. The specially designed software compares the characteristics of the contaminant peaks measured with those in its library, and by doing so identifies the particular contaminants on the surface. From the height of the peaks and the areas under them, the software will also be able to calculate quantities of contaminant present. Thus, the CAU will be a valuable tool in determining whether surface cleanliness meets or surpasses the specifications of a certain manufacturing process. What is unique about the CAU is that it can make these determinations in near-real-time (i.e. in a minute or two), whereas laboratory analyses typically take much longer (one or more orders of magnitude longer). The electronics in the cart are powered by standard 110 or 220 volt power, by means of standard power cords. The cart does not require other utility connections (such as air or water or gas).

While other instruments exist that can make quick measurements of surface contamination, the CAU is unique in that can measure extremely small quantities of surface contaminants to a high degree of precision, while at the same time being easily portable and able to be readily moved around an assembly line, and also able to measure and identify a wide variety of volatile and semivolatile contaminants (hydrocarbons, silicone oils) on a wide variety of substrates (metal surfaces, glass, plastics, composites, etc.).

Mass spectrometry is an analytical technique for identification of chemical structures, determination of mixtures, and quantitative elemental analysis, based on application of the mass spectrometer. Organic and inorganic molecular structure determination is based on the fragmentation pattern formed when the molecule is ionized; further, because such patterns are distinctive, reproducible, and additive, mixtures of known compounds may be quantitatively analyzed. Quantitative analysis of organic compounds requires either exact mass values from a high-resolution mass spectrometer, or libraries of fragmentation patterns of known compounds.

The principle applications of computers to analysis have been to data acquisition and structure interpretation. Mass spectra contain so much data that the rapid acquisition and presentation of data in a form easily assimilated by the operator has been adapted to the computer. Similarly, in cases where a gas chromatograph effluent passes through the source of the mass spectrometer, the generation of data is so rapid that a dedicated computer is necessary. A variety of data displays are useful for interpretation. The plot of total ion current versus time produces a reconstructed chromatogram; the plot of ions of a single mass versus time, called a mass fragmentogram, is useful in identifying compound classes among the gas chromatogram peaks if the appropriate mass is chosen, or in identifying compounds directly if some other mass like the molecular weight of a desired component is chosen.

For interpretation, two approaches have been used: library searching and training. Library searches of large collections (over 70,000 spectra) by comparison of the spectrum with known spectra yield degrees of closeness of agreement of the unknown and known spectra. Various algorithms for spectral comparison, using the 10 most intense peaks in the spectrum or the two most intense peaks in each 14-mass-unit segment, for example, have been devised, and the minimum amount of information to be supplied for a good chance of identification has been studied. The other approach involves several pattern recognition approaches in which various features of the spectra are correlated with structural characteristics by methods independent of formal theories of mass spectral interpretation; these include learning-machine and factor-analysis approaches. Hybrid techniques in which the self-trained computer approach is augmented by selected tests derived from the fragmentation theory noted previously, have also been devised.

Changes and modifications in the specifically described embodiments can be carried out without departing from the scope of the invention, which is intended to be limited by the scope of the appended claims.

We claim:

1. A portable contamination analysis unit, comprising:

a detector head, comprising:

a mass spectrometer for producing data;

an O-ring surrounding an opening in said detector head; and at least one vacuum valve between said O-ring and said mass spectrometer; and a wheeled cart, comprising:

means for controlling said mass spectrometer;

means for evacuating said mass spectrometer; and a computer comprising software for collecting and analyzing said data produced by said mass spectrometer.

2. The portable contamination analysis unit of claim 1, wherein said mass spectrometer is selected from a group consisting of a residual gas analyzer quadrupole mass spectrometer and a time-of-flight mass spectrometer.

3. The portable contamination analysis unit of claim 1, wherein said evacuating means comprise a roughing pump, roughing pump controller, a turbomolecular pump and a turbomolecular pump controller, wherein a first vacuum line connects said roughing pump to said detector head, and wherein a second vacuum line connects said turbomolecular pump to said detector head.

4. The portable contamination analysis unit of claim 3, wherein said roughing pump comprises a rotary vane pump.

5. The portable contamination analysis unit of claim 2, wherein said means for controlling said mass spectrometer comprise a residual gas analyzer controller connected by electrical cables to said mass spectrometer.

6. The portable contamination analysis unit of claim 3, wherein said detector head further comprises a pressure sensor located within said detector head.

7. The portable contamination analysis unit of claim 6, further comprising a pressure gauge electrically connected to said pressure sensor.

8. The portable contamination analysis unit of claim 1, wherein said detector head further comprises a heat source fixedly connected between said vacuum valve and said O-ring.

9. The portable contamination analysis unit of claim 8, wherein said heat source is selected from a group consisting of a nichrome wire, a nichrome coil, an infrared heater, a quartz heater and a laser.

10. The portable contamination analysis unit of claim 1, wherein said computer is a portable laptop computer.

11. The portable contamination analysis unit of claim 1, wherein said computer will plot data in graphical form.

12. The portable contamination analysis unit of claim 1, wherein said software comprises a library of typical contaminant signatures.

13. The portable contamination analysis unit of claim 12, wherein said software can compare said data with said typical contaminant signatures and identify particular contaminants.

14. The portable contamination analysis unit of claim 13, wherein said software can calculate the quantities of said contaminants.

15. The portable contamination analysis unit of claim 14; wherein said software can compare said data with said typical contaminant signatures to identify particular contaminants and can calculate the quantities of said contaminants all within two minutes.

16. The portable contamination analysis unit of claim 1, wherein said mass spectrometer, said means for evacuating said mass spectrometer, said means for controlling said mass spectrometer and said computer are all powered from alternating current/voltage selected from a group consisting of 110 volts and 220 volts.

* * * * *